US006756555B2

(12) United States Patent
Lin

(10) Patent No.: US 6,756,555 B2
(45) Date of Patent: Jun. 29, 2004

(54) PORTABLE KEYBOARD

(75) Inventor: Wen-Kuan Lin, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 10/136,274

(22) Filed: May 2, 2002

(65) Prior Publication Data

US 2003/0116418 A1 Jun. 26, 2003

(30) Foreign Application Priority Data

Dec. 21, 2001 (TW) ..... 90222507 U

(51) Int. Cl.[7] ..... H01H 1/10
(52) U.S. Cl. ..... 200/512; 200/517
(58) Field of Search ..... 200/512–517, 200/276.1, 329, 330, 341, 15 A, 491; 400/498, 496, 491, 490, 491.1, 491.2, 472, 495.1, 492, 495; 361/680; 341/22, 23

(56) References Cited

U.S. PATENT DOCUMENTS 4,302,648 A * 11/1981 Sado et al. ..... 200/512
4,349,712 A * 9/1982 Michalski ..... 200/513
4,363,942 A * 12/1982 Deeg et al. ..... 200/5 A
4,598,181 A * 7/1986 Selby ..... 200/5 A
4,794,215 A * 12/1988 Sawada et al. ..... 200/512
5,040,633 A * 8/1991 Donag ..... 180/275
5,220,521 A 6/1993 Kikinis
5,243,162 A * 9/1993 Kobayashi ..... 200/512
5,616,897 A 4/1997 Weber et al.
5,666,112 A 9/1997 Crowley et al.
5,924,555 A * 7/1999 Sadamori et al. ..... 200/512
6,174,097 B1 1/2001 Daniel
6,259,046 B1 * 7/2001 Iwama et al. ..... 200/5 A
6,265,993 B1 7/2001 Johnsom
6,333,477 B1 * 12/2001 Koyama et al. ..... 200/513
6,373,008 B1 * 4/2002 Saito et al. ..... 200/310

FOREIGN PATENT DOCUMENTS

JP 4028125 * 1/1992 ..... 200/512

* cited by examiner

*Primary Examiner*—Elvin Enad
*Assistant Examiner*—Lisa Klaus
(74) *Attorney, Agent, or Firm*—Birch, Stewart, Kolasch & Birch, LLP

(57) ABSTRACT

A portable keyboard consists of a pliable key body and a circuit body. The key body has a plurality of key caps which is embedded with an electric contact made from conductive rubber. The circuit body is embedded with a connection line made from conductive rubber. The keyboard thus constructed is highly pliable, and may be bent, folded or twisted without affecting the electronic characteristics of the keyboard.

9 Claims, 1 Drawing Sheet

PORTABLE KEYBOARD

FIELD OF THE INVENTION

The invention relates to a portable keyboard, and particularly a keyboard that allows users to bend, fold or twist into a small size to facilitate storing and carrying.

BACKGROUND OF THE INVENTION

Portable personal electronic data processing devices such as notebook computers, Personal Digital Assistants (PDAs) and the like allow users to process or read information anywhere anytime. Coupling with wireless data communication technology, obtaining information is even easier. With rapid technological innovations and developments, those portable electronic data processing devices have become leaner, and are more convenient for users to carry around.

In order to reduce the size of portable electronic data processing devices, many designs have to be changed. Taking input devices such as keyboards for instance, keys on notebook computers have to be shrunk and laid more closely together. On PDAs, the display devices have adopted touch screens and input is done by using stylus writing on the screen through pressure contact. In comparison, keyboards of general desktop computers have a more desirable interval between keys. Users may operate the keys on the keyboard with both hands. This is still the fastest and most comfortable input method at present, and is most commonly used. However, keyboards on notebook computers are reduced to a smaller size, and keys are smaller and laid closer to each other, to people who are used to conventional keyboards of desk top computers, notebook computer keyboards are not comfortable to use. As a result, input speed suffers. Moreover, the layouts of some keys on notebook computer keyboards are different from that of conventional desktop computer keyboards. PDAs have only a few keys and a touch screen for inputting, and are not suitable for entering large amounts of data. Their reduced sizes have compromised input convenience.

As notebook computers or PDAs have increasingly become indispensable tools for many people, in order to resolve these input problems, some manufacturers have developed and introduced various types of portable externally connected keyboards.

For instance, U.S. Pat. No. 6,174,097 discloses a foldable keyboard which is divided into a plurality of sections and employs turning shafts to connect various sections and allow them to fold and close against one another. When in use, the various sections may be unfolded. However such type of foldable keyboard still occupies substantial space when folded. Moreover, the pivotal connections of the turning shafts are prone to rupture. It is not a desirable keyboard design.

U.S. Pat. Nos. 6,265,993 and 5,220,521 disclose keyboards that can be wound in a roll. The proposed keyboards consist of a plurality of plastic membranes. The plastic membranes are printed with silver paste circuits. Through the designs of the plastic membranes and silver paste circuits, keyboards may be wound into a roll. However their pliability has limitations. When the roll is wound into too small of a diameter or even folded, the plastic membranes cannot be returned to their normal condition. Even when the plastic membranes are returned to their normal condition, the silver paste circuits could be stretched too much and broken, resulting in malfunction of some keys. Furthermore, these keyboards can only be bent into a curve but cannot be folded or stacked. In order to avoid compression or impact when carried, special storage barrels must be designed and provided for holding the rolled keyboards. Thus they are also not desirable keyboard designs.

U.S. Pat. Nos. 5,666,112 and 5,616,897 disclose pliable inflation keyboards. Although the keyboards can be bent, a portable inflation device has to be carried with each keyboard to inflate the keyboard when in use. They also are not desirable designs for portable keyboards.

SUMMARY OF THE INVENTION

The primary object of the invention is to provide a portable keyboard that allows users to bend, fold or twist.

The portable keyboard according to the invention includes a key body made from highly pliable and elastic materials and a circuit body. The key body includes a plurality of key caps. The key caps have conductive rubber embedded therein to form electric contacts. The circuit body has connection lines made from conductive rubber embedded therein. The structural elements of the keyboard of the invention are all highly pliable, thus may be bent, folded, or twisted without affecting electronic characteristics.

The foregoing, as well as additional objects, features and advantages of the invention will be more readily apparent from the following detailed description, which proceeds with reference to the accompanying drawings. The drawings are only to serve for reference and illustrative purposes, and are not intended to limit the scope of the invention.

DESCRIPTION OF THE PREFERRED EMBODIMENTS

Figure 1A:
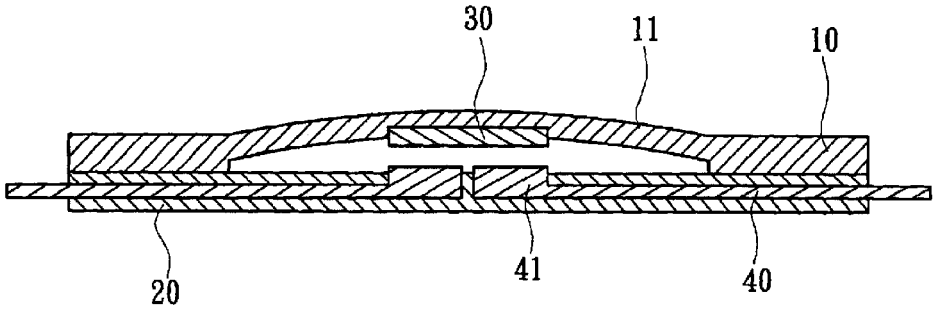
FIGS. 1A and 1B are schematic views of a first embodiment of the invention.

Referring to FIG. 1A, the portable keyboard of the invention consists of a key body 10 and a circuit body 20. The key body 10 is made from pliable materials, such as rubber, which is preferred. The key body 10 includes a plurality of key caps 11 (the drawing shows only one for illustrative purposes). The key caps 11 and key body 10 are integrally made by an injection forming process and are not separable. The key caps 11 have a substantially flat surface and are slightly bulged upwards. They maintain the upward bulging condition under normal circumstances, and may return to their normal condition when depressing is released. Each key cap 11 has a bottom section which has a first electric contact 30 located thereon. The first electric contact 30 is made from conductive rubber.

The circuit body 20 is made from highly pliable materials, such as rubber, which is preferred. The circuit body 20 has a connection line 40 embedded therein. The connection line 40 is made from conductive rubber. As the connection line 40 is embedded in the circuit body 20, it is isolated from ambience by means of the outer wall of the circuit body 20. The circuit body 20 further has a second electric contact 41 exposed at a location corresponding to the first electric contact 30.

Figure 1B:
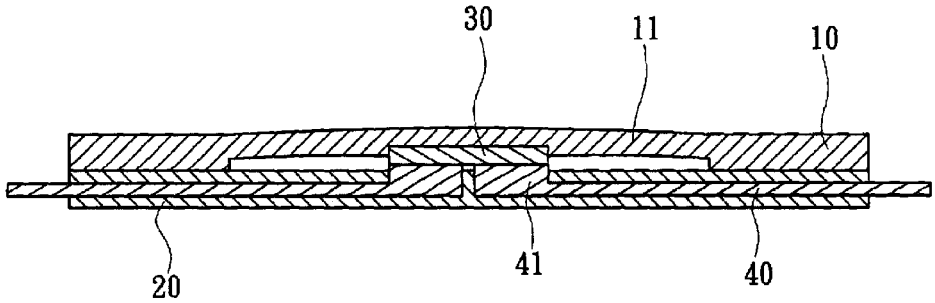

Referring to FIGS. 1A and 1B, the portable keyboard of the invention includes, by structural sequence, the key body 10, first electric contact 30, connection line 40, and circuit body 20. Under normal conditions, the key caps 11 maintain an upward bulging position. When one of the key caps 11 is depressed, he first electric contact 30 and the second electric contact 41 of the connection line 40 are connected and become conductive to complete a preset signal output. As the key body 10, first electric contact 30, connection line 40, and circuit body 20 are all made from highly pliable materials, the keyboard may maintain a flat profile under normal conditions. Users may plug a connector (may be a wired or wireless type) of the keyboard to an electronic data processor (such as a computer, not shown in the drawings), and the keyboard is ready for use. When a user wishes to store the keyboard, s/he may bend, fold or even twist the keyboard without affecting the electronic characteristics of the keyboard. When depressing is released, the keyboard may return to its original flat condition. Thus it is an excellent design for portable keyboards.

Figure 2:
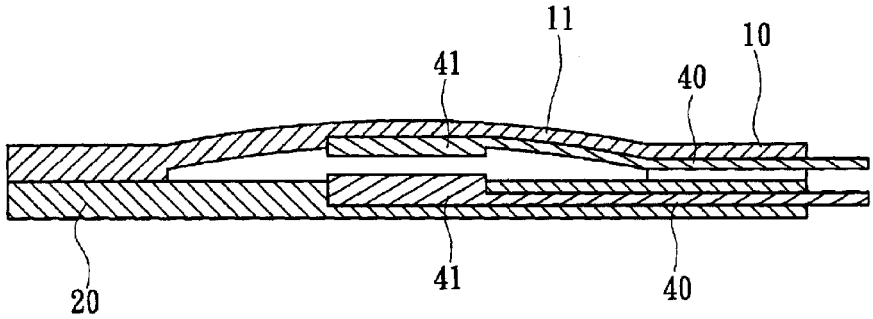
FIG. 2 is a schematic view of a second embodiment of the invention.

Refer to FIG. 2 for another embodiment of the invention. Therein both the key body 10 and the circuit body 20 have a connection line 40 embedded therein. Each connection line 40 has one exposed electric contact 41 located on a location corresponding to other exposed electric contact 41. Such a construction can also achieve the object of keyboard portability of the invention.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A portable keyboard, comprising:

a pliable and elastic circuit body; and a pliable and elastic key body having a plurality of key cap units;

wherein each key cap unit includes a key cap integrally formed and inseparable to the key body, a pliable first electric contact having a predetermined length disposed on a middle portion of an inner surface of the key cap and two pliable second electric contacts separated to each other and the first electric contact, and the second electric contacts respectively extended from two connection lines embedded in the circuit body;

whereby the first electric contact can be simultaneously touched to the second electric contacts through the key cap is pressed downwardly for forming an electrical connection therebetween.

2. The portable keyboard of claim 1, wherein the key body is made from rubber.

3. The portable keyboard of claim 1, wherein the pliable electric contact is made from conductive rubber.

4. The portable keyboard of claim 1, wherein the connection line is made from conductive rubber.

5. The portable keyboard of claim 1, wherein the circuit body is made from rubber.

6. The portable keyboard of claim 1, wherein the key caps are bulged upwards and maintain a gap with the circuit body.

7. The portable keyboard of claim 1, wherein the connection line is embedded in the circuit body and is exposed at a location corresponding to the electric contact.

8. The portable keyboard of claim 1, wherein the connection line is embedded in the key body.

9. A portable keyboard, comprising:

a pliable and elastic circuit body; and a pliable and elastic key body having a plurality of key cap units;

wherein each key cap unit includes a key cap integrally formed and inseparable to the key body and two pliable electric contacts separated to each other and respectively disposed on a middle portion of an inner surface of the key cap and the circuit body, and the electric contacts respectively extended from two connection lines respectively adhesive to the inner surface of the key cap and embedded in the circuit body, whereby the two electric contacts can be touched to each other through the key cap is pressed downwardly for forming an electrical connection therebetween.

* * * * *